US007047761B2

(12) United States Patent
Hwang et al.

(10) Patent No.: US 7,047,761 B2
(45) Date of Patent: May 23, 2006

(54) STAND-TYPE AIR CONDITIONER

(75) Inventors: Yoon-Jei Hwang, Seoul (KR); Ji-Young Jang, Gyeonggi-Do (KR); Chan-Ho Song, Gyeonggi-Do (KR); Jeong-Taek Park, Seoul (KR)

(73) Assignee: LG Electronics Inc., Seoul (KR)

( * ) Notice: Subject to any disclaimer, the term of this patent is extended or adjusted under 35 U.S.C. 154(b) by 4 days.

(21) Appl. No.: 11/034,793

(22) Filed: Jan. 14, 2005

(65) Prior Publication Data

US 2006/0037355 A1 Feb. 23, 2006

(30) Foreign Application Priority Data

Aug. 19, 2004 (KR) ..... 10-2004-0065543

(51) Int. Cl.
*F25D 17/06* (2006.01)

(52) U.S. Cl. ..... 62/428; 62/305

(58) Field of Classification Search ..... 62/426, 62/427, 428, 429, 305, 505
See application file for complete search history.

(56) References Cited

U.S. PATENT DOCUMENTS 3,585,811 A * 6/1971 Friedel ..... 62/173
4,958,500 A * 9/1990 Kuroda et al. ..... 62/89
5,271,242 A * 12/1993 Addington ..... 62/285
6,447,391 B1 * 9/2002 Kim et al. ..... 454/324

* cited by examiner

*Primary Examiner*—Melvin Jones
(74) *Attorney, Agent, or Firm*—Birch, Stewart, Kolasch & Birch, LLP

(57) ABSTRACT

A stand-type air conditioner including a casing having at least two air discharge openings and an air suction opening, and a blower fan installed therein. Also included are at least two heat exchangers positioned adjacent to the air discharge openings, respectively, in the casing for exchanging heat with air to be discharged through the air discharge openings. Further, at least one of the air discharge openings is located at a lower portion of the casing in the vicinity of the ground for discharging air near the ground. By discharging cold air from an upper side during the cooling operation and hot air from a lower side during the heating operation, the cold air or the hot air can be evenly distributed to the room. Accordingly, uniform cooling/heating can be realized to thereby significantly increase reliability and efficiency of a product.

24 Claims, 6 Drawing Sheets

STAND-TYPE AIR CONDITIONER

BACKGROUND OF THE INVENTION

1. Field of the Invention

The present invention relates to a stand-type air conditioner, and more particularly, to a stand-type air conditioner which allows cold air or hot air to be selectively discharged near the ground as well as to an upper side.

2. Description of the Background Art

In general, an air conditioner keeps a room temperature comfortable by using a freezing cycle comprising a compressor, a condenser, an expansion valve and an evaporator. In the air conditioner, the compressor compresses a refrigerant to increase pressure of the refrigerant up to saturation pressure and then the condenser absorbs heat which the high-pressure refrigerant has by using water or air to thereby liquefy the refrigerant. Decompressed by the expansion valve, the liquefied refrigerant flows into the evaporator, is evaporated and exchanges heat with indoor air, so that the indoor air can be kept comfortable. The air conditioner is classified into an integral type and a split type according to whether or not an indoor unit and an outdoor unit are coupled with each other. Moreover, according to installations of the indoor unit, the split type is divided into a wall-mounted type in which the air conditioner is fixedly installed at a wall surface and a stand-type in which the air conditioner stands on a floor.

FIG. 1 is a perspective view showing an indoor unit of the conventional stand-type air conditioner. FIG. 2 is a side sectional view showing the indoor unit of the conventional stand-type air conditioner.

As shown therein, the indoor unit of the conventional stand-type air conditioner (hereinafter, called "Stand-type air conditioner") includes: a casing 1, a blower fan 2 installed at a lower portion of the inside of the casing 1 and sucking/discharging air; an evaporator 3 installed at an upper portion of the inside of the casing 1 and cooling the air having been sent from the blower fan 2 by exchanging heat with the air; and a flow channel guide (not shown) interposed between the blower fan 2 and the evaporator 3 and guiding the air sucked/discharged to/from the blower fan 2 to the evaporator 3.

In the casing 1, an air suction unit 1*a* for sucking air is formed at a front surface of the lower portion of the casing 1 and an air discharge unit 1*b* for discharging the heat-exchanged air is formed at a front surface or a side surface of the upper portion of the casing 1.

The blower fan 2 is a turbo fan, a kind of centrifugal fan, for sucking air through the air suction unit 1*a*, and pressing and discharging the air, and it is coupled with a fan motor (not shown).

The flow channel guide is formed as a streamline using styrofoam or plastic materials, in which its surface is mostly formed to be flat such that air can be smoothly sent toward the evaporator 3.

However, in the conventional stand-type air conditioner, cold air or hot air is discharged only to an upper portion. Accordingly, in case of cooling, cold air discharged from the air conditioner is heavier than that of indoor air to thereby convey the cold air as far as an indoor floor surface, which allows uniform cooling. On the other hand, in case of heating, hot air is lighter than indoor air not to thereby convey the hot air as far as the floor surface, which makes uniform heating difficult.

SUMMARY OF THE INVENTION

Therefore, an object of the present invention is to provide a stand-type air conditioner capable of evenly transmitting wind to upper and lower sides of the room during heating as well as cooling.

To achieve these and other advantages and in accordance with the purpose of the present invention, as embodied and broadly described herein, there is provided a stand-type air conditioner comprising: a casing having at least two air discharge openings and an air suction opening, and a blower fan installed therein; and at least two heat exchangers positioned adjacent to the air discharge openings, respectively, in the casing for exchanging heat with air to be discharged through the air discharge openings, wherein at least one of the air discharge openings is located at a lower portion of the casing in the vicinity of the ground for discharging air near the ground.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Hereinafter, a stand-type air conditioner will be described in detail in accordance with one embodiment which is shown in the accompanying drawings.

There can be a plurality of embodiments in accordance with the present invention, and, hereinafter, the most preferable embodiment will be described.

In addition, a description will be made only to an indoor unit of the stand-type air conditioner, for which a stand-type air conditioner will be short.

Figure 1:
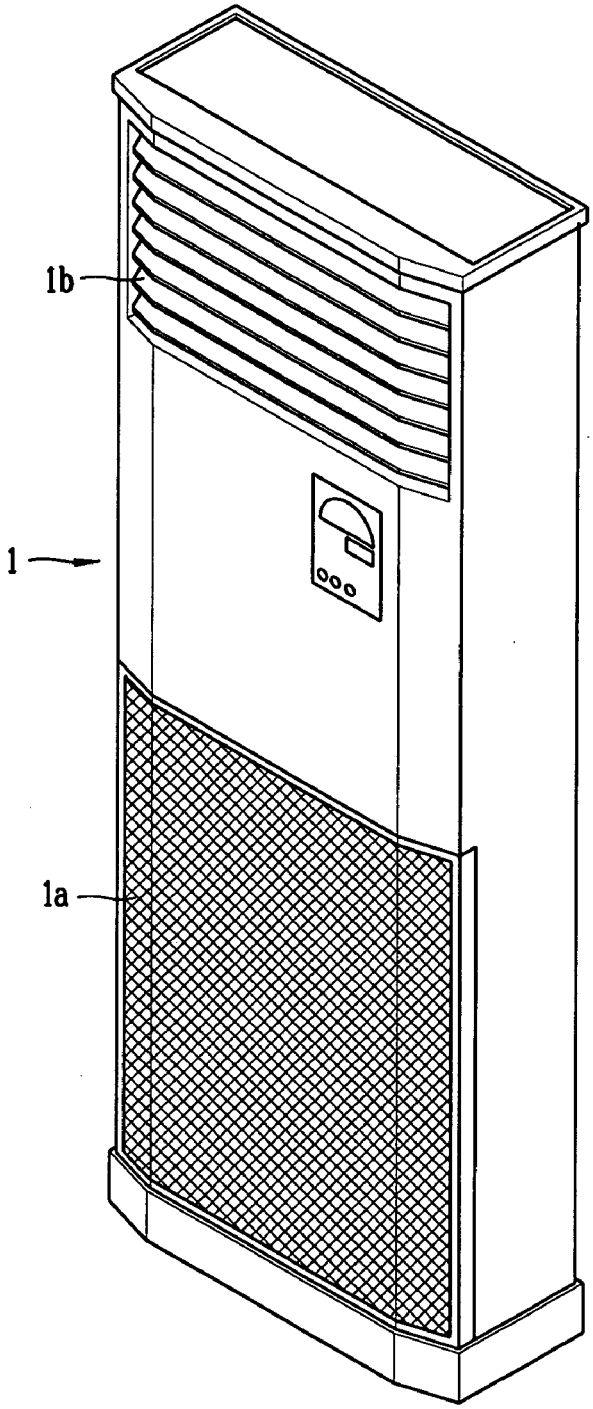
FIG. 1 CONVENTIONAL ART
FIG. 1 is a perspective view showing an indoor unit of the conventional stand-type air conditioner.
Figure 2:
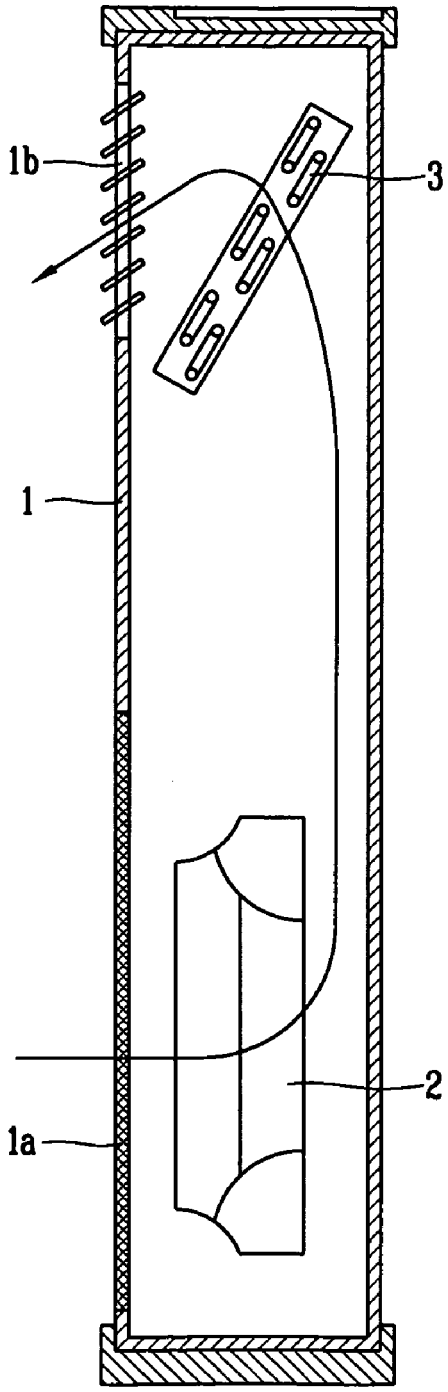
FIG. 2 CONVENTIONAL ART
FIG. 2 is a side sectional view showing the indoor unit of the conventional stand-type air conditioner.
Figure 3:
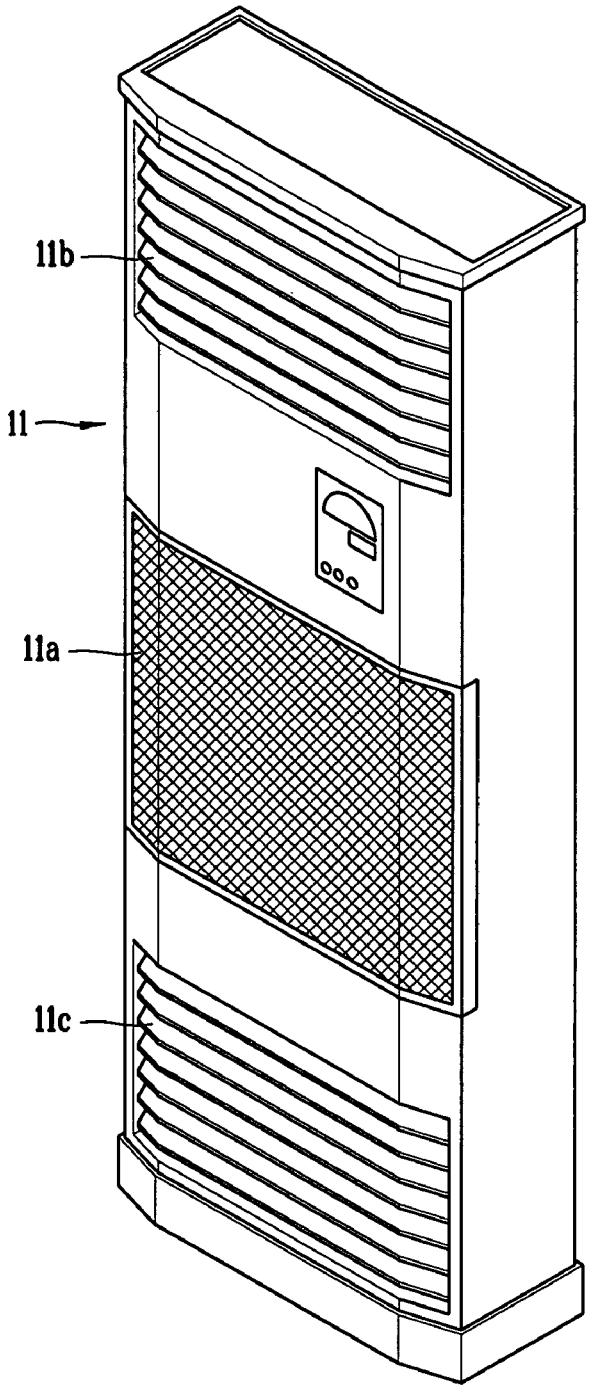
FIG. 3 is a perspective view showing an indoor unit of a stand-type air conditioner in accordance with the present invention.
Figure 4:
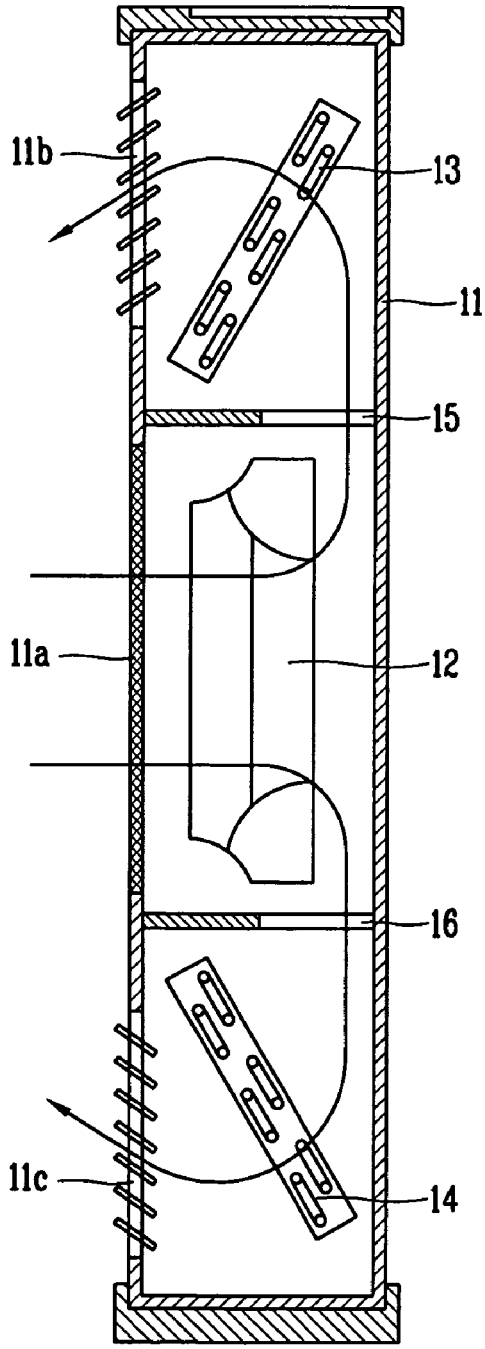
FIG. 4 is a side sectional view showing the indoor unit of the stand-type air conditioner in accordance with the present invention.

FIG. 3 is a perspective view showing a stand-type air conditioner in accordance with the present invention, and FIG. 4 is a side sectional view showing the stand-type air conditioner in accordance with the present invention.

As shown therein, the stand-type air conditioner in accordance with the present invention is provided with a casing 11 having at least two air discharge openings 11*b* and 11*c* and an air suction opening 11*a*, and a blower fan 12 installed therein, and at least two heat exchangers 13 and 14 positioned adjacent to the air discharge openings 11*b* and 11*c*, respectively, for exchanging heat with air to be discharged through the air discharge openings 11*b* and 11*c*.

At this time, at least one of the air discharge openings 11*b* and 11*c* is located at a lower portion of the casing 11 in the vicinity of the ground such that air can be discharged near the ground.

Namely, as shown in FIG. 4, air is discharged from the casing 11 near the indoor floor through the air discharge opening 11*c* formed at the lower portion of the casing 11.

The air suction opening 11*a* is formed in the middle of one side of the casing 11 in order that the sucked air can be evenly distributed to air the discharge openings 11B and 11C.

Namely, the air discharge openings 11*b* and 11*c* comprise a first air discharge opening 11B formed at the upper portion of the casing 11 on the basis of the air suction opening 11*a* and a second air discharge opening 11*c* formed at the lower portion of the casing and near the ground. For efficiency of air flow, the air discharge openings 11*b* and 11*c* and the air suction opening 11*a* are preferably formed on the same surface of the casing 11.

In addition, as for the air discharge openings 11*b* and 11*c*, it is possible to form additional air discharge openings at both sides of the casing 11 so as to discharge air to a wider range.

In addition, the heat exchangers 13 and 14 installed in the casing 11 for exchanging heat with air flowing into the casing 11 comprise a first heat exchanger 13 positioned adjacent to the first air discharge opening 11*b* and a second heat exchanger 14 positioned adjacent to the second air discharge opening 11*c*.

Meanwhile, the blower fan 12, installed in the casing 11 and near the air suction opening 11*a*, sucks air from the outside of the casing 11 through the air suction opening 11*a* and transmits the sucked air to the first heat exchanger 13 and the second heat exchanger 14. At this time, a flow channel guide (not shown) is formed between the blower fan 12 and the first and second heat exchangers 13 and 14, and guides the air having passed through the blower fan 12 toward the first heat exchanger 13 and the second heat exchanger 14.

Accordingly, most preferably, the blower fan 12 is constructed as a turbo fan, a kind of centrifugal fan, coupled with a fan motor (not shown) for sucking indoor air, and pressing and discharging the sucked indoor air.

In addition, the first and second heat exchangers 13 and 14 are preferably inclined at a certain angle to the direction in which air flows so as to make an air contact surface area larger.

Meanwhile, flow channel control means for controlling the amount of air which flows from the blower fan 12 to the first heat exchanger 13 and the second heat exchanger 14 are provided in the casing 11.

The flow channel control means comprise a first flow channel control means 15 controlling air flow from the blower fan 12 toward the first heat exchanger and installed at a flow channel therebetween and a second flow channel control means 16 controlling air flow from the blower fan 12 toward the second heat exchanger 14 and installed at a flow channel therebetween.

Figure 5:
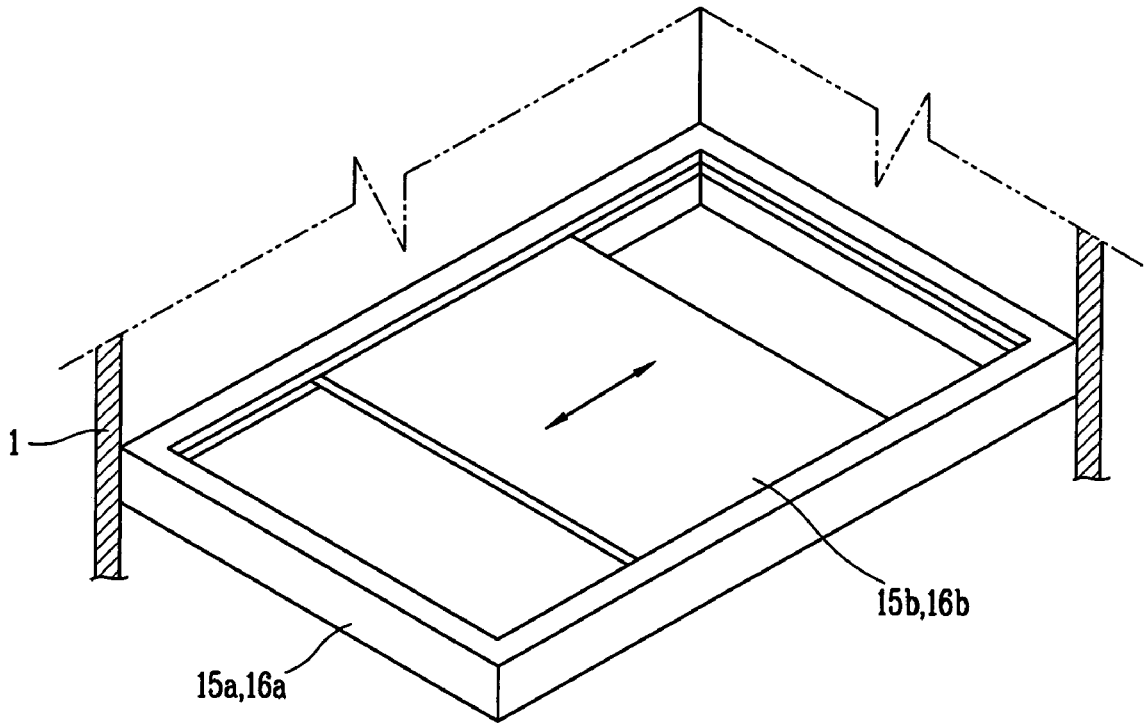
FIG. 5 is a perspective view showing one example of a flow channel control means of the indoor unit of the stand-type air conditioner in accordance with the present invention.

As shown in FIG. 5, the first and second flow channel control means 15 and 16 include guide rails 15*a* and 16*a* fixedly installed perpendicular to the flow channels and doors 15*b* and 16*b* slidingly coupled with the guide rails 15*a* and 16*b*, thereby controlling the amount of air flow.

The flow channel control means are capable of controlling the amount of air flow by opening/closing the doors 15*b* and 16*b*. However, most preferably, a user automatically controls an opening/closing degree through a remote control from the outside. In addition, through a built-in program, the opening/closing degree can be controlled according to cooling/heating degrees.

During heating, since the flow channel from the blower fan 12 toward the first heat exchanger 13 is blocked by the first flow channel control means 15, air heated passing through the second heat exchanger 14 is discharged to the outside of the casing 11 through the second air discharge opening 11*c*. In that case, a flow of a refrigerant is blocked toward the first heat exchanger 13 and the refrigerant flows only toward the second heat exchanger 14, which allows to use energy efficiently.

On the contrary to this, during cooling, since the flow channel from the blower fan 12 toward the second heat exchanger 14 is blocked by the second flow channel control means 16, air cooled passing through the first heat exchanger 13 is discharged to the outside of the casing 11 through the first air discharge opening 11*b*. Likewise, in that case, a flow of a refrigerant is blocked toward the second heat exchanger 14 and the refrigerant flows only toward the first heat exchanger 13, which allows energy efficiently, too.

Moreover, during cooling or heating, both of the first and second flow channel control means 15 and 16 are opened to thereby make it possible for air cooled or heated passing through the first and second heat exchangers 13 and 14 to be discharged to the outside of the casing 11 through the first and second air discharge openings 11*b* and 11*c*. At this time, the refrigerants are supplied to both of the first and second heat exchangers 13 and 14.

Figure 6:
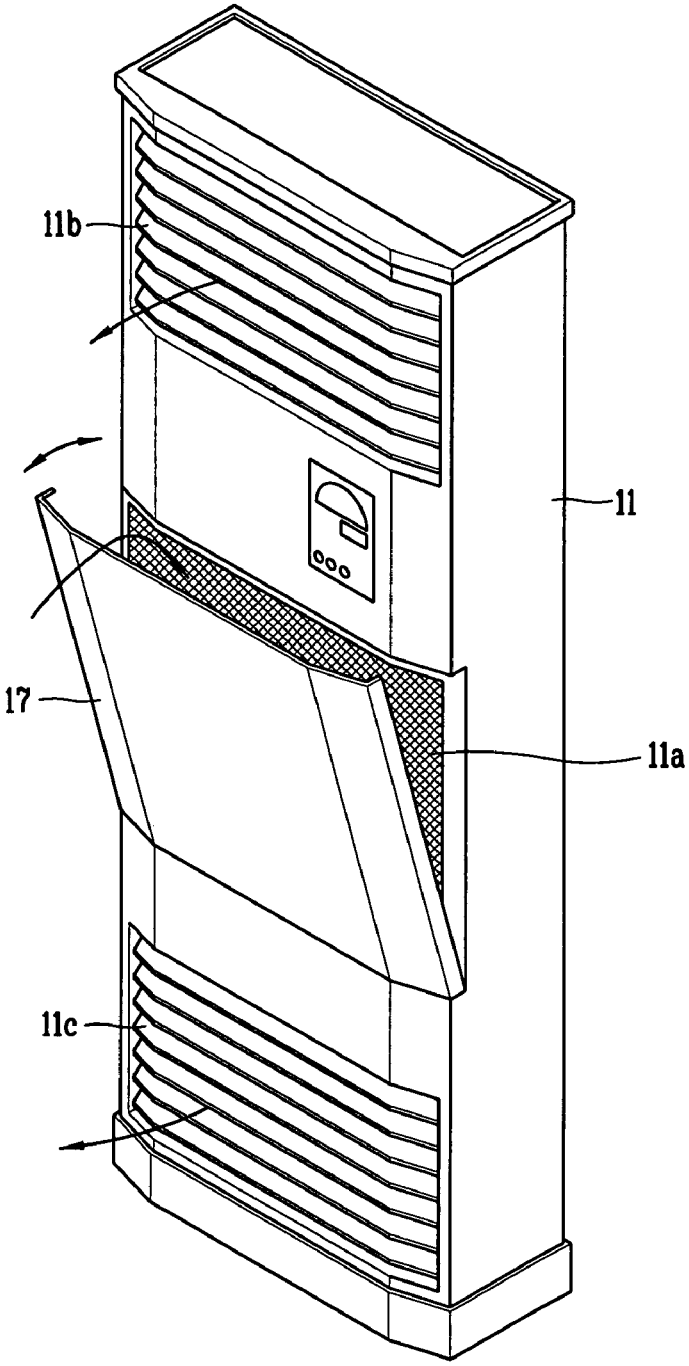
FIG. 6 shows another embodiment of the stand-type air conditioner in accordance with the present invention.

FIG. 6 shows another embodiment of the stand-type air conditioner in accordance with the present invention.

As shown in FIG. 6, in order to block the air suction opening 11*a* and prevent the air suction opening from being contaminated by foreign substances such as dust when the air conditioner does not operate, an opening/closing means 17 for opening/closing the air suction opening 11*a* is provided. Accordingly, the air suction opening is selectively opened during the operation of the air conditioner.

Because of such a fact, it is also possible to selectively open/close the air discharge openings 11*b* and 11*c* only when the air conditioner operates. The user can easily perform the operation of opening/closing the air suction opening 11*a* and the air discharge openings 11*b* and 11*c*.

An operation of the stand-type air conditioner of the present invention will be described.

That is, the general operation of the stand-type air conditioner is as follows. When the power is applied to drive a compressor, a refrigerant is compressed, condensed passing a condenser, decompressed and expanded passing an expansion valve, evaporated after flowing into an evaporator and sucked to the compressor again. A series of processes are repeated. At this time, air passing the condenser become hot air because it receives heat from the condenser, while air passing the evaporator becomes cold air because the evaporator takes away its heat. That is, in case of cooling, the exchanger positioned adjacent to the air discharge opening in the casing exchanges heat with indoor air and generates cold air, functioning as the evaporator, while, in case of heating, the heat exchanger exchanges heat with indoor air and generates hot air, functioning as the condenser.

Here, in case of the stand-type air conditioner, discharging cold air as far as a ceiling is appropriate to evenly cool the room, but discharging hot air as far as a floor is appropriate to evenly heat the room.

In case of the stand-type air conditioner in which such facts are sufficiently taken into accounts, in accordance with the present invention, during heating, air sucked through the air suction opening 11*a* by suction force of the blower fan 12, positioned in the middle of the casing 11, passes through the second heat exchanger 14 which is positioned at the lower portion of the casing 11 and which the refrigerant is supplied to, and then is discharged to the outside of the casing 11 through the second air discharge opening 11*c*. At this time, the amount of air flow is controlled by the second flow channel control means 16 between the blower fan 12 and the second heat exchanger 14. On the contrary to this, the refrigerant is not supplied to the first heat exchanger 13 positioned at the upper portion of the casing 11, and the flow channel between the blower 12 and the first heat exchanger 13 is blocked by the first flow channel control means 15, thereby preventing the squandering of energy.

During cooling, air sucked through the air suction opening 11*a* by suction force of the blower fan 12 passes through the first heat exchanger 13, which is positioned at the upper surface of the casing 11 and which the refrigerant is supplied to, and then is discharged to the outside of the casing 11 through the first air discharge opening 11*b*. At this time, the amount of air flow is controlled by the first flow channel control means 15 between the blower fan 12 and the first heat exchanger 13. On the contrary to this, the refrigerant is not supplied to the second heat exchanger 14 positioned at the lower portion of the casing 11, and the flow channel between the blower fan 12 and the second heat exchanger 14 is blocked by the second flow channel control means 16, thereby preventing the squandering of energy.

Meanwhile, according to the user's selection, during cooling/heating, both of the first heat exchanger 13 and the second heat exchanger 14 operate, and both of the first and second flow channel control means 15 and 16 are opened, thereby discharging the heat-exchanged air to the outside of the casing 11 through both of the first air discharge opening 11*b* and the second air discharge opening 11*c*.

In the stand-type air conditioner in accordance with the present invention, which operates as described, uniform cooling/heating can be realized by evenly supplying cold air or hot air to the room.

As described, in the stand-type air conditioner in accordance with the present invention, air discharge openings are formed at both upper and lower sides of the casing, respectively, each of heat exchangers is installed therein, and flow channel control means for controlling the amount of air flowing to each of the heat exchangers are installed, respectively. According to this, during the cooling operation, cold air can be discharged from the upper side, while during the heating operation, hot air can be discharged from the lower side. In addition, during cooling/heating, cold air or hot air can be discharged through air discharge openings formed at the upper and lower portions of the casing. Accordingly, cold air or hot air can be evenly distributed to the room to thereby realize uniform cooling/heating, which enables to significantly increase reliability and efficiency of a product.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A stand-type air conditioner comprising:

a casing having at least two air discharge openings and an air suction opening, and a blower fan installed therein;

at least two heat exchangers positioned adjacent to the air discharge openings, respectively, in the casing for exchanging heat with air to be discharged through the air discharge openings;

a first flow channel control means controlling air flow from the blower fan toward a first heat exchanger of the at least two heat exchangers and installed at a flow channel therebetween; and a second flow channel control means controlling air flow from the blower fan toward a second heat exchanger of the at least two heat exchangers and installed at a flow channel therebetween, wherein at least one of the air discharge openings is located at a lower portion of the casing in the vicinity of the ground for discharging air near the ground.

2. The stand-type air conditioner of claim 1, wherein the air suction opening is formed in the middle of the casing.

3. The stand-type air conditioner of claim 2, wherein the air discharge openings comprise:

a first air discharge opening formed at an upper portion of the casing on the basis of the air suction opening; and a second air discharge opening formed at a lower portion of the casing and near the ground.

4. The stand-type air conditioner of claim 3, wherein:

the first heat exchanger is positioned adjacent to the first air discharge opening, and the second heat exchanger is positioned adjacent to the second air discharge opening.

5. The stand-type air conditioner of claim 4, wherein the blower fan is installed adjacent to the air suction opening, and sucks air from the outside of the casing and transmits the sucked air to the first heat exchanger and the second heat exchanger.

6. The stand-type air conditioner of claim 5, wherein the blower fan is a turbo fan.

7. The stand-type air conditioner of claim 5, wherein the first and second heat exchangers are inclined at a certain angle to the direction in which air transmitted from the blower fan flows so as to make an air contact surface area larger.

8. The stand-type air conditioner of claim 1, wherein the flow channel control means comprise:

guide rails fixedly installed perpendicular to the flow channels; and doors slidingly coupled with the guide rails and controlling the amount of air flow.

9. The stand-type air conditioner of claim 1, wherein, during heating, since the flow channel from the blower fan toward the first heat exchanger is blocked by the first flow channel control means, air heated passing through the second heat exchanger is discharged to the outside of the casing through the second air discharge opening.

10. The stand-type air conditioner of claim 1, wherein, during cooling, since the flow channel from the blower fan toward the second heat exchanger is blocked by the second flow channel control means, air cooled passing through the first heat exchanger is discharged to the outside of the casing through the first air discharge opening.

11. The stand-type air conditioner of claim 1, wherein, during cooling or heating, since both of the first and second flow channel control means are opened, air cooled or heated passing through the first and second heat exchangers is discharged to the outside of the casing through the first and the second discharge openings.

12. The stand-type air conditioner of claim 9, wherein the refrigerant is supplied only to the second heat exchanger.

13. The stand-type air conditioner of claim 10, wherein the refrigerant is supplied only to the first heat exchanger.

14. The stand-type air conditioner of claim 11, wherein the refrigerants are supplied to both of the first and second heat exchangers.

15. A stand-type air conditioner comprising:

a casing having at least two air discharge openings and an air suction opening, and a blower fan installed therein; and at least two heat exchangers positioned adjacent to the air discharge openings, respectively, in the casing for exchanging heat with air to be discharged through the air discharge openings; and an opening/closing means for blocking the air suction opening when the air conditioner does not operate, wherein at least one of the air discharge openings is located at a lower portion of the casing in the vicinity of the ground for discharging air near the ground.

16. An air conditioner comprising:

a casing having at least first and second air discharge openings and an air suction opening on a front surface thereof;

a blower fan installed within the casing; and at least first and second heat exchangers positioned adjacent to the first and second air discharge openings, respectively, in the casing for exchanging heat with air to be discharged through the first and second air discharge openings, wherein the first air discharge opening is located at a lower front portion of the casing in the vicinity of the ground for discharging heated air near the ground, and the second air discharge opening is located at an upper front portion of the casing for discharging cooled air.

17. The air conditioner of claim 16, further comprising:

a controller configured to control air flow from the blower fan toward the first and second heat exchangers.

18. The air conditioner of claim 17, wherein the controller closes the air flow from the blower fan to the second heat exchanger during a heating operation such that the heated air is only discharged from the first heat exchanger, and closes the air flow from the blower fan to the first heat exchanger during a cooling operation such that the cooled air is only discharged from the second heat exchanger.

19. The air conditioner of claim 17, wherein the controller comprises:

a first flow controller configured to control the air flow from the blower fan toward the first heat exchanger and installed at a flow channel therebetween; and a second flow controller configured to control the air flow from the blower fan toward the second heat exchanger and installed at a flow channel therebetween.

20. The air conditioner of claim 19, wherein the first and second flow controllers are manually controlled, are automatically controlled via remote control or are automatically controlled based on a measured temperature.

21. The air conditioner of claim 17, wherein the controller comprises:

guide rails fixedly installed perpendicular to the flow channels; and doors slidingly coupled with the guide rails and controlling the amount of air flow.

22. The air conditioner of claim 16, wherein the air suction opening is formed in the middle of the casing between the first and second air discharge openings and includes an opening/closing mechanism configured to block the air suction opening when the air conditioner is not operating.

23. The air conditioner of claim 16, wherein the at least first and second air discharge openings further include third and fourth air discharge openings located on respective sides of the casing so as to discharge air to a wider range.

24. The air conditioner of claim 16, wherein the first and second heat exchangers are inclined at a certain angle to the direction in which air transmitted from the blower fan flows so as to make an air contact surface area larger.

* * * * *